US005114037A

United States Patent [19]

Hillis et al.

[11] Patent Number: 5,114,037

[45] Date of Patent: May 19, 1992

[54] CONTAINER WITH SIDEWALL EXTENSION

[75] Inventors: Mark Hillis; Dixon Freeman, both of Tacoma, Wash.

[73] Assignee: Perstorp Xytec, Inc., Tacoma, Wash.

[21] Appl. No.: 701,602

[22] Filed: May 14, 1991

Related U.S. Application Data

[63] Continuation of Ser. No. 540,234, Jun. 19, 1990, abandoned.

[51] Int. Cl.[5] ..... B65D 7/24

[52] U.S. Cl. ..... 220/4.03; 220/1.5; 220/6

[58] Field of Search ..... 220/1.5, 6, 4.03

[56] References Cited

U.S. PATENT DOCUMENTS

| | | | |
|---|---|---|---|
| 3,316,460 | 4/1967 | Scoville | 317/101 |
| 3,809,278 | 5/1974 | Csumrik | 220/4 F |
| 4,044,910 | 8/1977 | Box | 220/6 X |
| 4,454,946 | 6/1984 | Yokowo | 206/600 |
| 4,546,896 | 10/1985 | Reid | 220/4 F |
| 4,674,647 | 6/1987 | Gyenge et al. | 220/6 |
| 4,693,386 | 9/1987 | Hughes et al. | 220/1.5 |
| 4,714,169 | 12/1987 | Keenan et al. | 220/8 |
| 4,735,330 | 5/1988 | Hoss | 220/6 |
| 4,775,068 | 10/1988 | Reiland et al. | 220/1.5 X |

*Primary Examiner*—Steven M. Pollard

*Attorney, Agent, or Firm*—Townsend and Townsend

[57] ABSTRACT

A container with collapsible sidewalls is provided with a sidewall extension. The sidewall extension increases the height of the sidewall pivot axis above the container base. When the sidewalls are collapsed a portion of the container volume remains for holding, for example, packing material or dunnage.

1 Claim, 10 Drawing Sheets

CONTAINER WITH SIDEWALL EXTENSION

This is a continuation of application Ser. No. 07/540,234, filed Jun. 19, 1990, now abandoned.

BACKGROUND OF THE INVENTION

The present invention relates to a container with collapsible sidewalls and in particular to a container which retains an internal volume after collapse of the sidewalls.

Containers used for handling and shipping materials are well known and found in a range of sizes and uses. Materials-handling containers have found increasing use with the introduction of "just in time" production methods. Such containers are often produced in a foldable or collapsible form in order that return shipping of the containers will require a minimum of space. This type of container is generally described in U.S. Pat. No. 4,674,647 issued Jun. 23, 1987, to Gyenge, et al. Previous devices have typically attempted to provide the collapsed container in a form which is as compact as possible, with no substantial internal spaces or volumes in the collapsed form. This configuration has presented difficulties when the containers are used in connection with package or dunnage because once the container is collapsed, there is no room for containing such packing material or dunnage and thus the packing material or dunnage must either be disposed of or must separately packaged for return in a different container.

Typical previous devices have used sidewalls which are dimensioned such that when they are collapsed they do not extend beyond the perimeter defined by the container base. Some such containers have sidewalls dimensioned so that they do not extend beyond a midline of the container base. In either case, the vertical extend (in the uncollapsed configuration) of the sidewall is determined by the size of the base. Accordingly, previous devices did not provide containers with a range of sidewalls heights, independent of the base size.

SUMMARY OF THE INVENTION

The present invention includes a container which has a sidewall extension structure coupled to the container base and extending perpendicularly to the plane of the base. One or more sidewalls are pivotally attached to the sidewall extension. When the sidewalls are pivoted from the upright configuration to the collapsed configuration, a volume is retained inside the container. The volume is defined, roughly, by the base, the sidewall extension and the collapsed sidewalls. This space is available for holding packing material or dunnage for return shipment or other uses. Because the sidewall extension also adds to the height of the container, sidewall extension provides a container having a height which can be greater than the container would have if the sidewalls were attached directly to the base, as in previous devices. Preferably, several sizes of sidewall extensions are provided so that containers with different vertical extents can be produced. In one embodiment, the sidewalls can be attached to either the sidewall extension or the base so that the same parts used for building a container having no sidewall extension can also be used for building a container having the sidewall extension. The top of the sidewall extension preferably is substantially similar to, more preferably, congruent with, the perimeter or rim of the base.

In one embodiment, the sidewall extension includes four panels. Preferably, two of the panels are attached to the base by pushing towards the rim of the base in a lateral direction while the other two panels are attached by pushing in a vertical direction. Preferably the corners of the panels interlock.

In another embodiment, the sidewall extension is attached as a single, preferably unitary piece.

DETAILED DESCRIPTION OF THE PREFERRED EMBODIMENTS

Figure 1A:
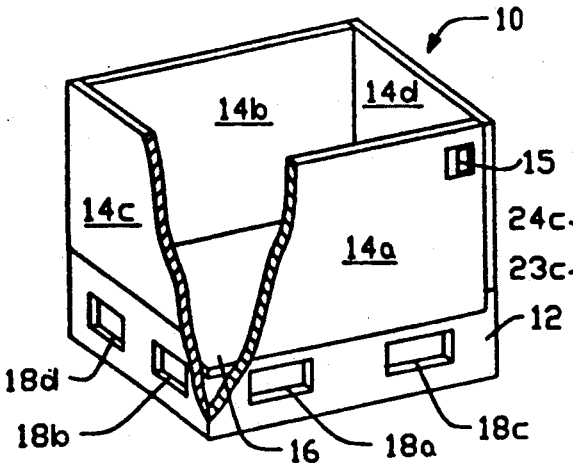
(PRIOR ART) FIG.—1A
FIG. 1A is a perspective, partially broken away view of a container according to previous designs.
Figure 1B:
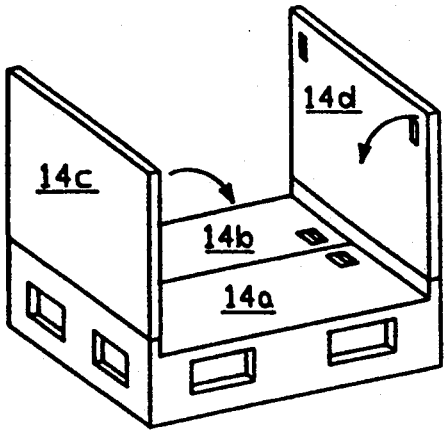
(PRIOR ART) FIG.—1B
FIG. 1B is a perspective of the container FIG. 1A with first and second sidewalls collapsed.
Figure 1C:
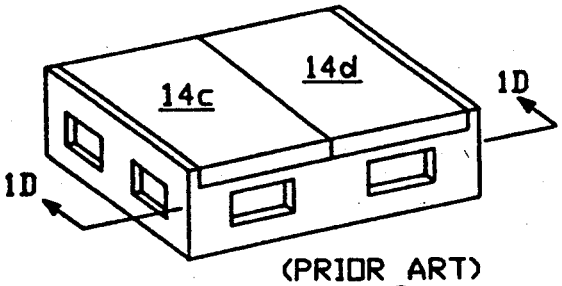
(PRIOR ART) FIG.—1C
FIG. 1C is a perspective view of the container of FIG. 1A with all four sidewalls collapsed.
Figure 1D:
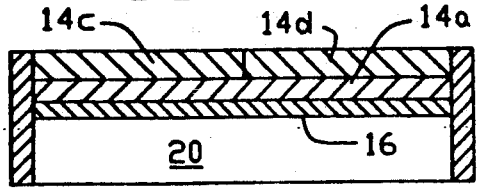
(PRIOR ART) FIG.—1D
FIG. 1D is a cross-sectional view taken along line 1D—1D of FIG. 1C.

To facilitate the description of the present invention, certain aspects of previous devices will first be discussed. As shown in FIG. 1A, a container 10 according to previous devices includes a base 12' and four sidewalls 14*a*, 14*b*, 14*c*, 14*d*. The base 12' can include holes 18*a*, 18*b*, 18*c*, 18*d* for forklifts. The usable interior volume of the container is defined by the four walls 14*a*, 14*b*, 14*c*, 14*d* and a floor 16. The walls 14*a*, 14*b*, 14*c*, 14*d* are pivotally connected to the base 12'. The walls include latches (not shown) for maintaining them in the upright configuration depicted in FIG. 1A. A number of latching devices can be used including those described in U.S. Pat. No. 4,674,647 issued Jun. 23, 1987 to Gyenge, et. al. incorporated by reference. When the latches are released, the walls can pivot to fold towards the base 12'. One type of latch is a slide latch 15 (FIG. 3C) movable from a first latch position 17*a*, which engages the first sidewall 14*a* with the second sidewall 14*d*, to a second position 17*b*, which releases the sidewalls 14*a*, 14*d*. As shown in FIG. 1B, the first and second walls, 14*a*, 14*b* can collapse substantially flush with the floor 16. Thereafter, as shown in FIG. 1C, the third and fourth walls, 14*c*, 14*d* can pivot around the base 12' to collapse substantially flush against the first and second walls. In the collapsed configuration, as shown in FIG. 1D, although there is a space 20 underneath the floor 16 for accommodation of the forklift, above the floor 16 there is substantially no volume remaining of the original container 10. As seen in FIG. 1D the first sidewall 14*a* and second sidewall (not shown in FIG. 1D) are substantially flush against the floor 16 and the third and fourth sidewalls 14*c*, 14*d* are substantially flush against the first sidewall 14*a*.

Figure 2A:
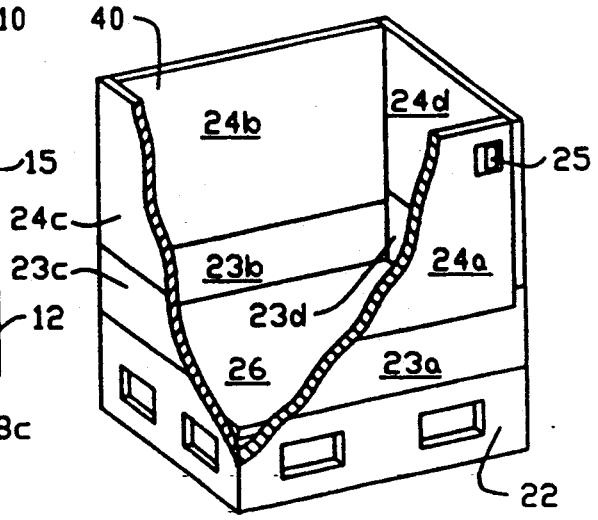
FIG. 2A is a perspective, partially broken-away view of a container according to the present invention.

FIG. 2A is a simplified schematic depiction of a container according to the present invention. The container can be made of a number of materials, preferably the entire container is formed by injection-molding plastic techniques. This structure is most advantageously formed with a material such as high-density polyethylene. The thickness of the sidewalls and base will be determined by the strength and durability requirements for any particular container. Ribbing or reinforcement may be provided for wall members in a pattern according to principles well known in the art. Preferably, the inside surfaces of the sidewalls and floor are smooth and free of obstructions so as to be easily cleaned and prevent damage to sensitive contents.

Figure 3A:
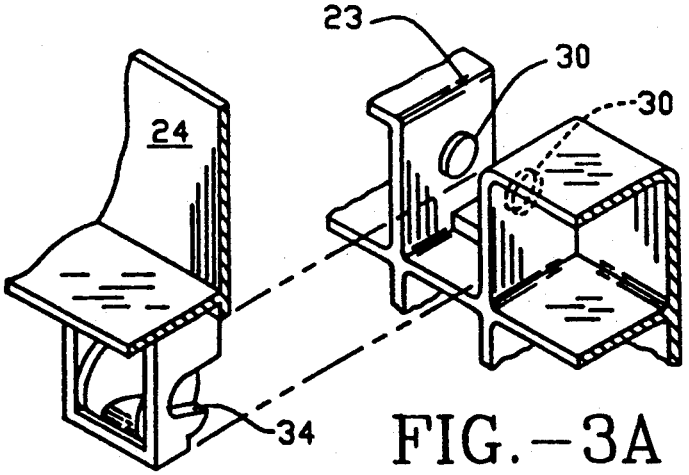
FIGS. 3A and 3B are exploded perspective views of sidewall hinge connections.
Figure 3B:
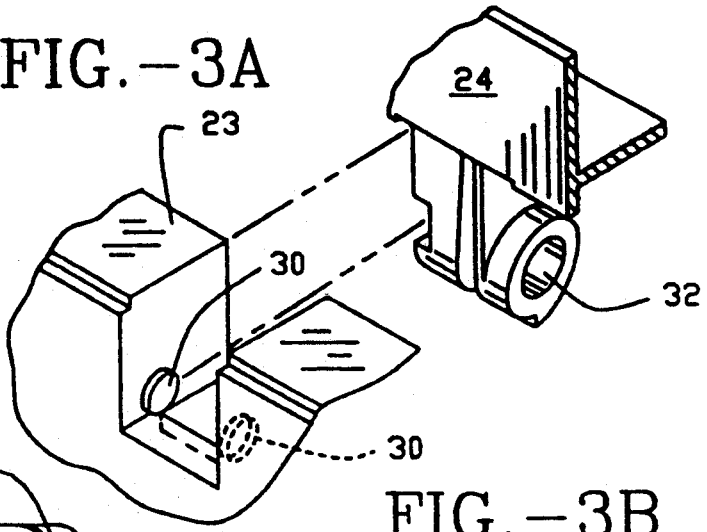
Figure 3C:
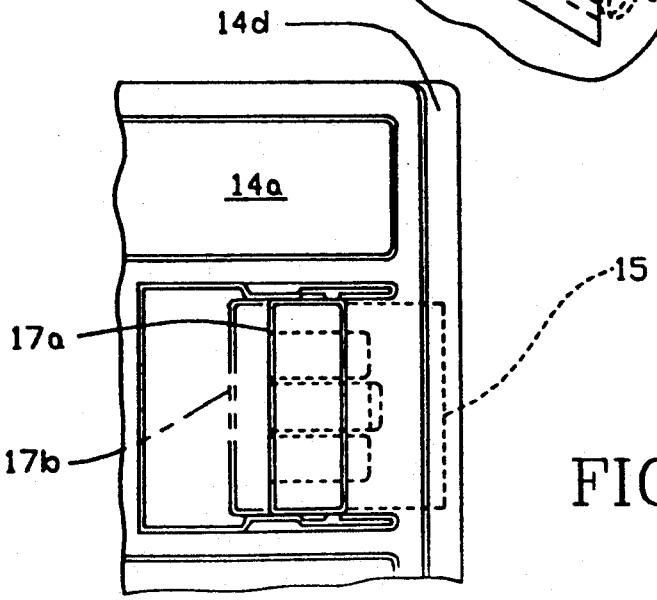
FIG. 3C is a partial side elevational view showing a sidewall latch.

The container includes a base 22 and first, second, third, and fourth sidewalls 24*a*, 24*b*, 24*c*, 24*d* connected to the base 22 by sidewall extensions 23*a*, 23*b*, 23*c*, 23*d*. Each depicted sidewall extension 23*a*, 23*b*, 23*c*, 23*d* is a substantially planar panel. The extensions 23*a*, 23*b*, 24*c*, 23*d* are attached to the base 22 in a non-pivoting manner. The sidewalls 24*a*, 24*b*, 24*c*, 24*d* are pivotally connected to the extensions 23*a*, 23*b*, 23*c*, 23*d*, respectively. A number of hinges can be used for this purpose. Two such hinges are depicted in FIGS. 3A and 3B. In each case, the sidewall extension 23 includes pins 30 which engage hubs 32 or slots 34 of the sidewall 24 to provide for pivoting, hinged connection between the sidewall extension 23 and the sidewall 24. A latch 25, which can be, e.g., similar to the above-described latch 15 releasably, repeatably latches the sidewalls in the upright configuration.

Figure 2B:
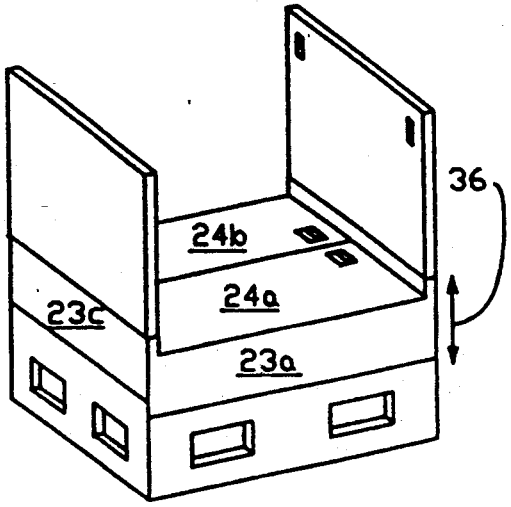
FIG. 2B is a perspective view of the container of FIG. 2A with the first and second sidewalls collapsed.
Figure 2C:
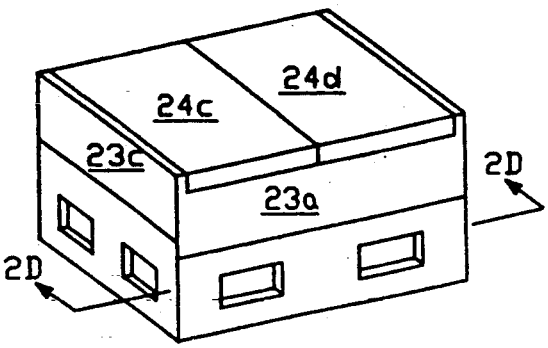
FIG. 2C is a perspective view of the container of FIG. 2A with all four sidewalls collapsed.
Figure 2D:
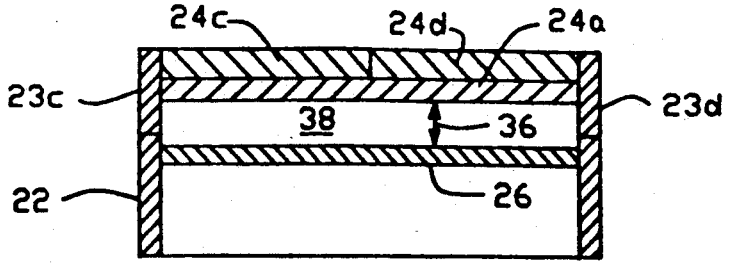
FIG. 2D is a cross-sectional view taken along line 2D—2D of FIG. 2C.

As shown in FIG. 2B when the first and second sidewalls 24*a*, 24*b* are pivoted to their collapsed configuration, the sidewall extension 23*a* maintains the sidewall 24*a* spaced a distance 36 above the floor 26. When the third and fourth sidewalls 24*c*, 24*d* are moved to their collapsed configuration as shown in FIG. 2C, they are substantially adjacent to the first and second sidewalls 24*a*, 24*b*. This relationship is seen in FIG. 2D. A space 38, having a height 36 which was formerly a portion of the interior volume 40 of the upright container (FIG. 2A) is thus formed between the collapsed sidewalls 24*a*, 24*c*, 24*d* and the floor 26. This space 38 is available for storing packing material or dunnage for return shipment.

Figure 4:
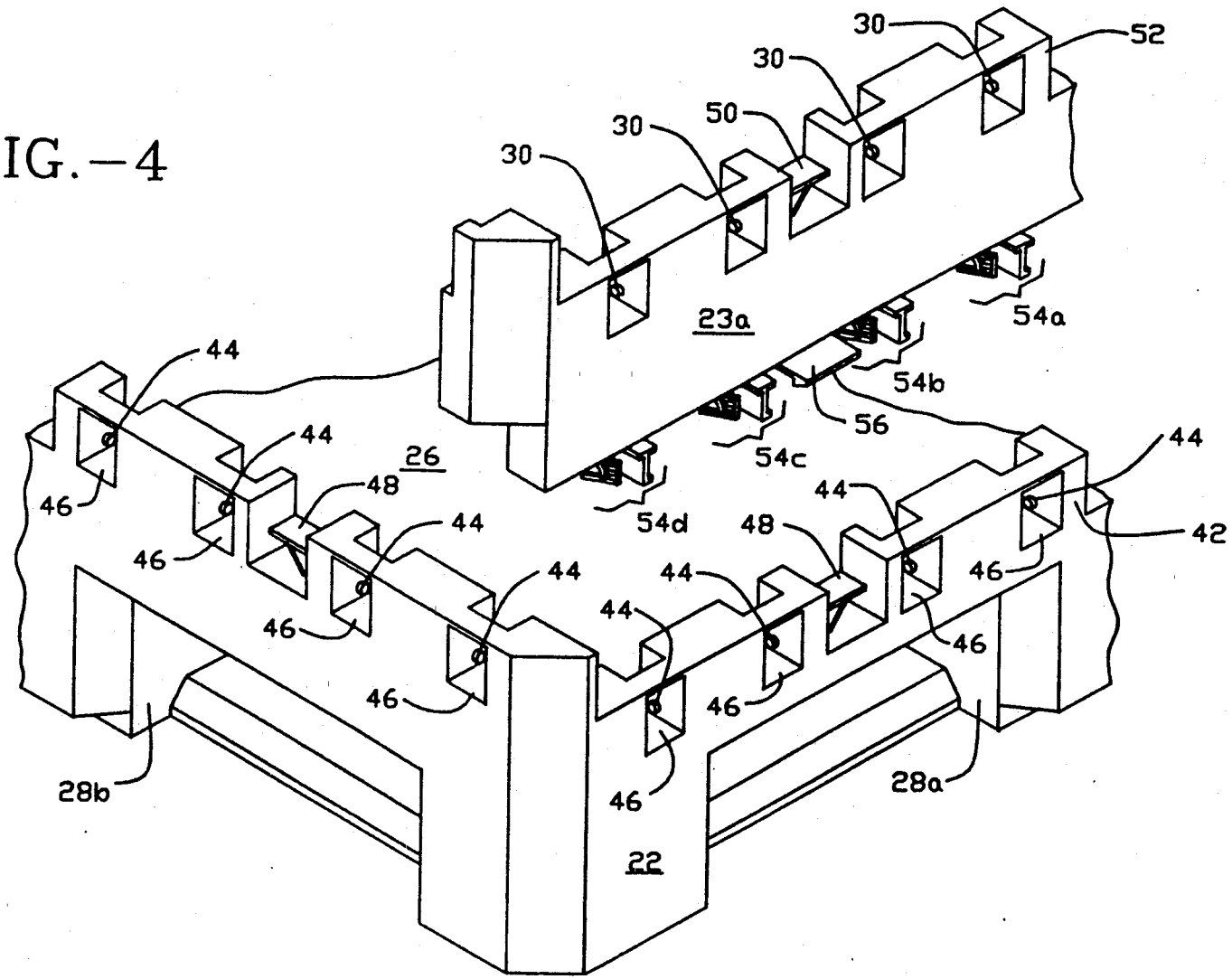
FIG. 4 is an exploded perspective partial view of a base component and first sidewall extension component according to the present invention.

FIG. 4 depicts the inter-connection of the first sidewall extension 23*a* to the base 22 according to a first embodiment of the present invention. The base 22 includes the floor 26 and an upwardly projecting rim 42. Underneath the floor 26 is a space connecting to openings 28*a*, 28*b* for forklifts.

The rim 42 of the base includes a plurality of engagement devices, which are preferably pins 44, positioned in holes 46. Preferably the pins 44 are positioned and sized identically to the pins 30 of the sidewall extensions 23. Although FIG. 4 shows only pins on one side of each hole 46 preferably, there is a pin on each side of the hole similar to the configuration for a sidewall extension pins 30 depicted in FIGS. 3A and 3B. One or more shelves 48 are also positioned in the rim 42 of the base 22. The shelves 48 are shaped and positioned identically to shelves 50 of the sidewall extension 23. As can be seen from FIG. 4, preferably the rim 52 of the sidewall extension is identical in shape to the rim 42 of the base.

Figure 5A:
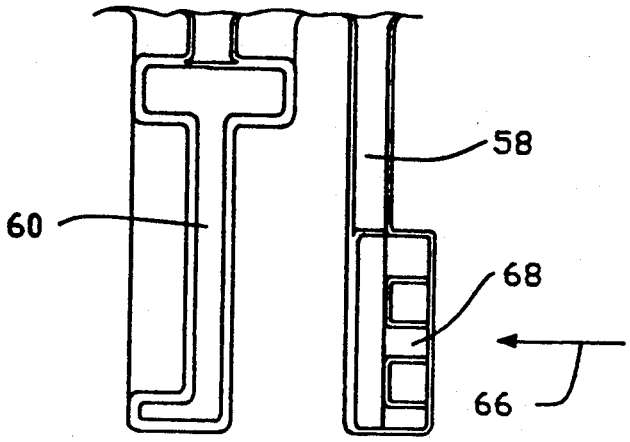
FIG. 5A is a side elevational view of a coupling device of the sidewall extension of FIG. 4.
Figure 5B:
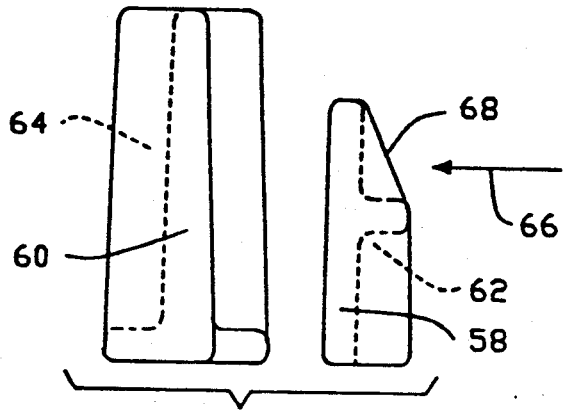
FIG. 5B is a bottom plan view the coupling device of FIG. 5A.

Along the lower edge of the first sidewall extension 23*a* are a plurality of coupling devices 54*a*, 54*b*, 54*c*, 54*d* and a base latch 56. FIGS. 5A and 5B depict the coupling devices 54 in greater detail. Each coupling device includes first and second arms 58, 60. The first arm 58 includes a recess 62. The second arm 60 includes a slot 64. The recess 62 and slot 64 are configured to accommodate the base pins 44. The first arm 58 is resiliently connected to the first sidewall extension 23*a* (and preferably integrally formed therewith) to permit the arm to be flexed sideways, towards the second arm, in response to application of a force in the direction shown by the arrow 66. The leading edge 68 of the first arm 58 is sloped or ramped.

Figure 6:
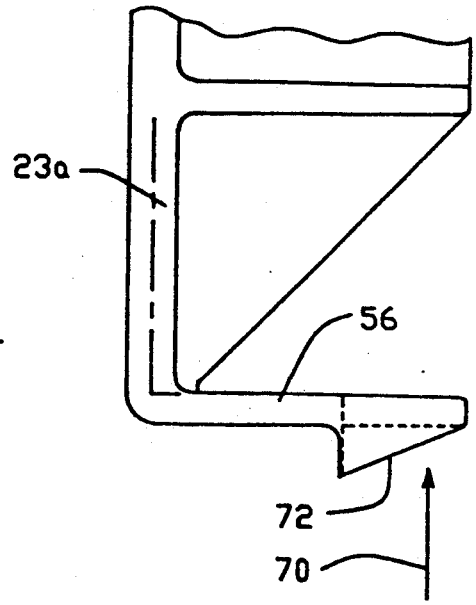
FIG. 6 is a side view of a second coupling device of the sidewall extension of FIG. 4.

FIG. 6 is a side view of the base latch 56. The base latch 56 is resiliently connected to the sidewall connection 23*a* to permit its flexure in an upward direction when a force is applied upwardly in the direction indicated by the arrow 70. The lower leading surface 72 of the latch 56 is sloped or ramped.

Figure 7:
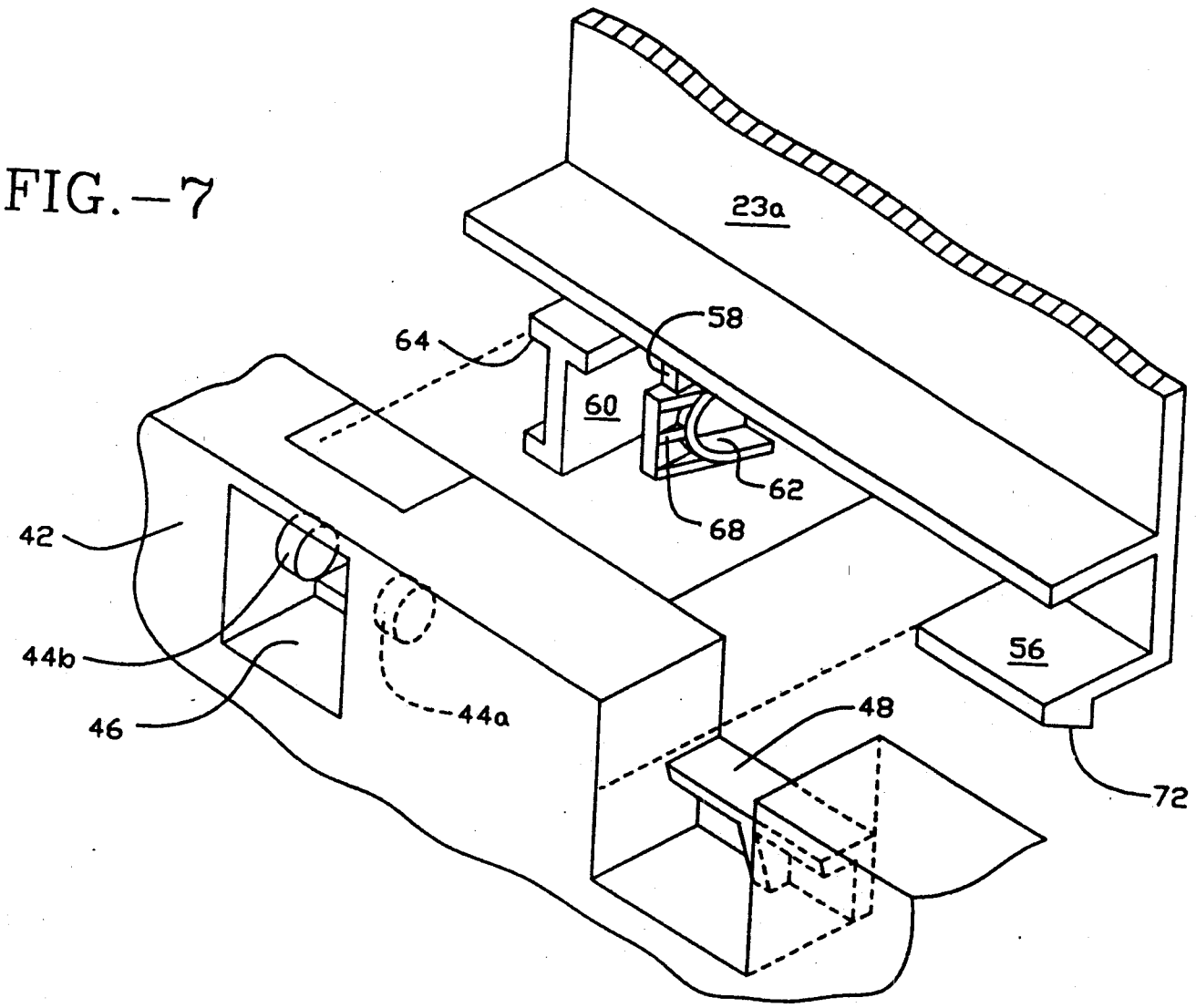
FIG. 7 is a detailed of an exploded perspective view of the base and first sidewall extension of FIG. 4.
Figure 8:
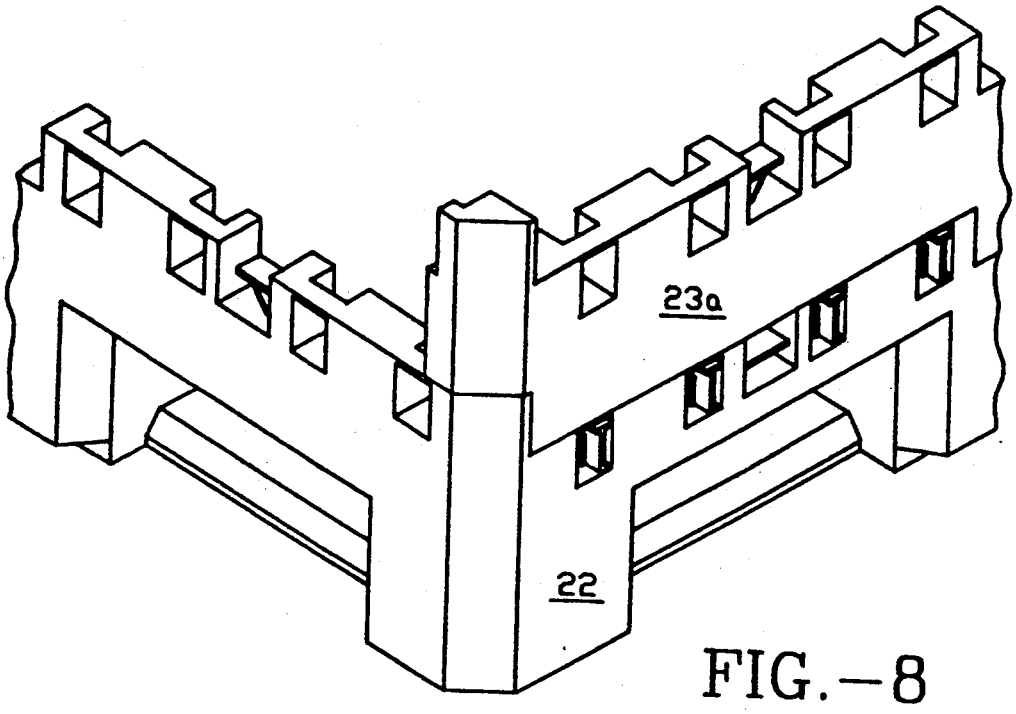
FIG. 8 is a perspective view of a base portion and first sidewall extension attached thereto.

To assemble the sidewall extension 23*a* to the base 22 the sidewall assembly 23*a* is first moved downwardly towards the base 22 to align the coupling devices 54 with the openings 46 and the latch 56 with the shelf 48. Once laterally aligned, as depicted in FIG. 7, the sidewall extension 23*a* is moved horizontally toward the rim 42 of the base. When the leading edge 68 of the first arm 58 contacts the corresponding pin 44*a*, further horizontal movement towards the rim 42 creates a lateral force on the arm 58 causing it to flex in a direction towards the second arm 64. Simultaneously, the shelf 48 contacts the ramped surface 72 of the latch 56 causing the latch to flex upwardly. Further horizontal movement towards the rim 42 causes the first arm 58 and the latch 56 to flex sufficiently to clear the pin 44*a* and shelf 48, respectively. The second pin 44*b* is engaged in the slot 64 of the second arm 60. When the pin 44*a* and shelf 48 are clear respectively, of the first arm ramp 68 and latch 72, the first arm 58 and latch 56 snap back into their original position, due to their inherent resiliency, thus positioning the pin 44*a* in the first arm recess 62 and positioning the shelf 48 behind the ramp surface 72. The combined interaction of the coupling device 54 with the pins 44 and the latch 56 with the shelf 48 holds the sidewall extension 23*a* in the configuration depicted in FIG. 8. The configuration and assembly of the second sidewall extension 23*b* is substantially identical of that described with respect to the first sidewall extension 23*a*.

Figure 10:
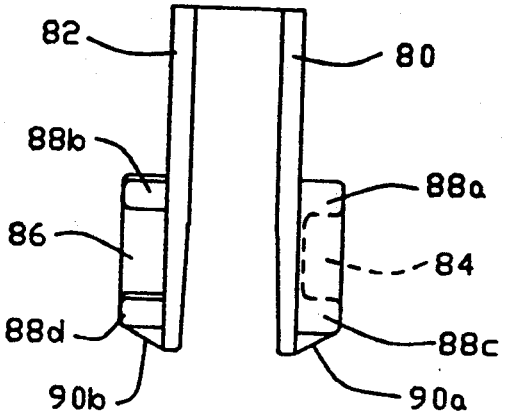
FIG. 10 is a side elevational view of a coupling device of the second sidewall extension according to the present invention.
Figure 9:
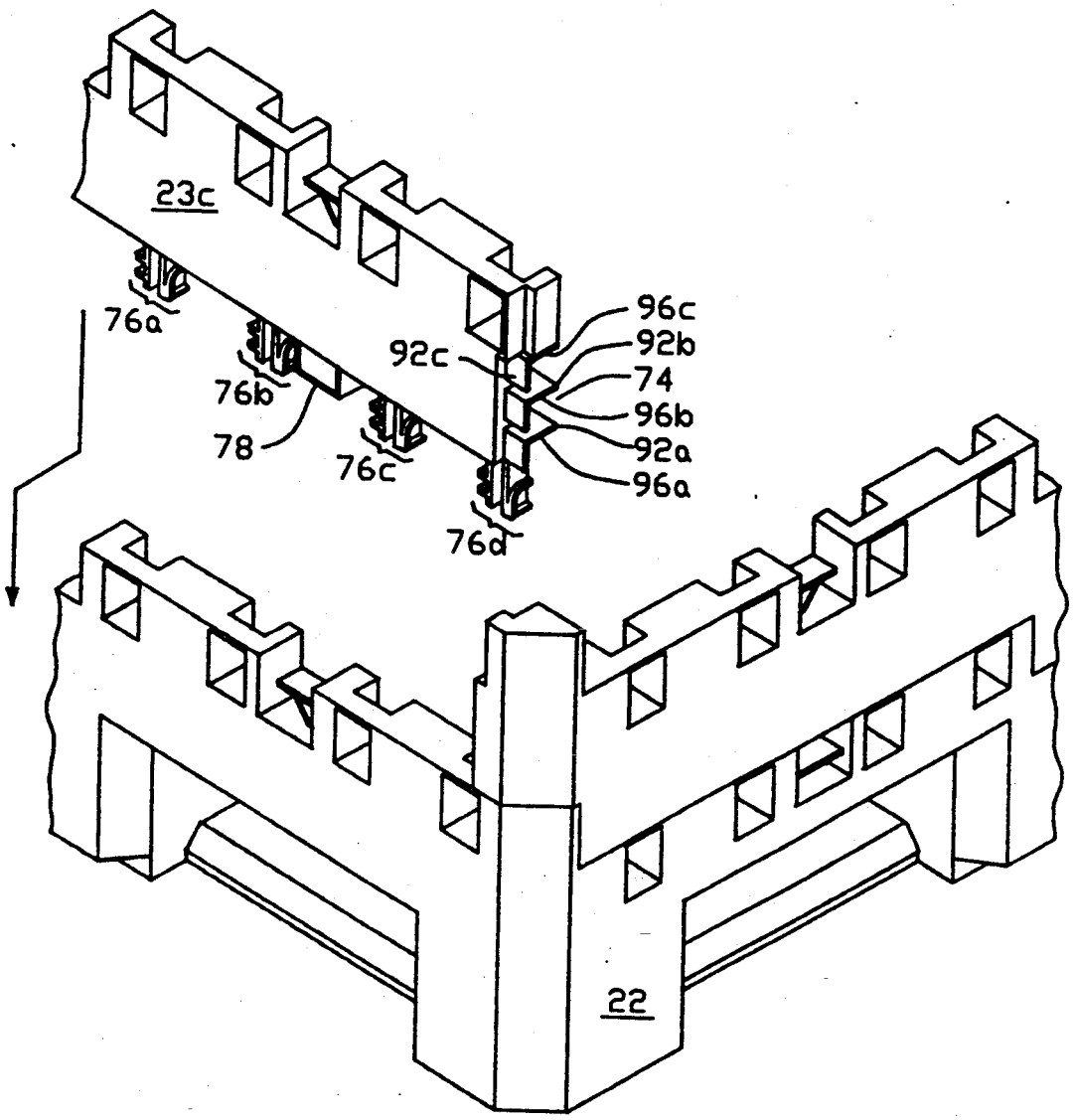
FIG. 9 is a partial perspective exploded view of the base portion and first and second sidewall portions of the container according to the first embodiment of the present invention.

FIG. 9 depicts the assembly of the third sidewall extension 23*c*. The configuration of the third sidewall extension 23*c* is substantially identical to the configuration of the first sidewall extension 23*a* except for the shape of the corner latching apparatus 74, the coupling devices 76*a*, 76*b*, 76*c*, 76*d* and the provision of a surface 78 rather than the latch 56 found in the first sidewall extension 23*a*. The configuration of the coupling device 76 is shown in greater detail in FIG. 10. As seen in FIG. 10, the coupling device 76 includes first and second arms 80, 82 which define recesses 84, 86. The recesses 84, 86 include upper walls 88*a*, 88*b* and lower walls 88*c*, 88*d*. The recesses 84, 86 are open on one side. The recess 84 at the first arm 80 is open towards the interior of the container while the recess 86 of the second arm 82 is open toward the exterior of the container.

A principle distinction between the coupling devices 76 of the third sidewall extension 23*a* and those 54 of the first sidewall extension 23*a* are that the sloped or ramped surfaces 90*a*, 90*b* in the third sidewall extension coupling devices 76 are sloped downwardly whereas those 68 in the first sidewall extension coupling devices 54 were slated laterally or horizontally. This is because the third and fourth sidewall extensions are engaged with the base 22 by moving downwardly rather than horizontally. The downward engagement direction is provided in order to accommodate the corner latching device 74 below.

Figure 11:
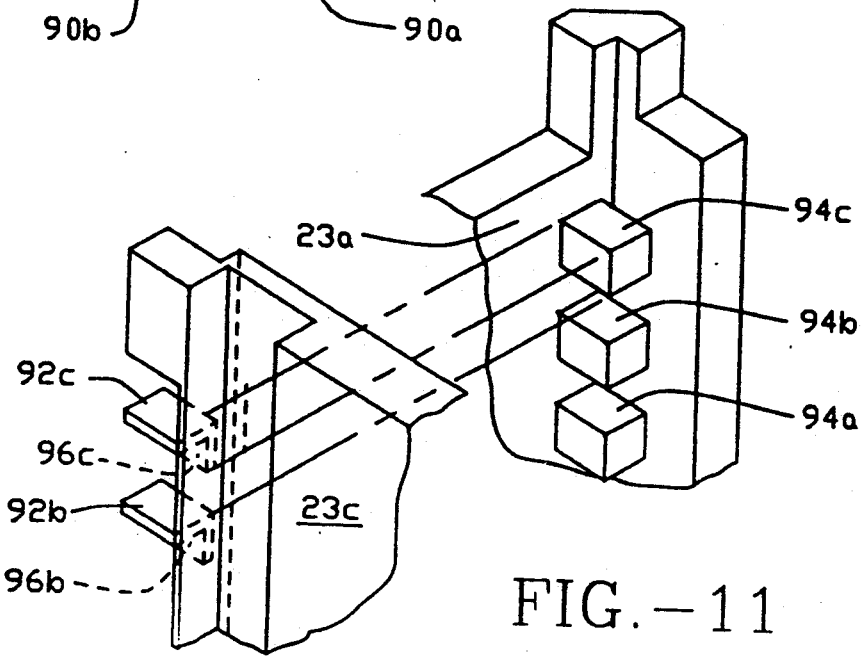
FIG. 11 is a detail exploded perspective view of a base portion and second sidewall portion of FIG. 9.

As seen in FIG. 9, the corner latching device 74 includes a plurality of L-shaped shelves 92*a*, 92*b*, 92*c*. The shelves 92*a*, 92*b*, 92*c* are configured to engage with blocks 94*a*, 94*b*, 94*c* attached to the inside edge surface of the first sidewall extension 23*a* as best seen in FIG. 11. To engage the third sidewall extension 23*c* with the first sidewall extension 23*a* and the base 22, the third sidewall extension 23*c* is first vertically aligned such that the blocks 94*a*, 94*b*, 94*c* are horizontally aligned with the spaces between the third sidewall extension shelves 92*a*, 92*b*. The third sidewall extension 23*c* is then moved towards the blocks 94 so that the blocks 94 pass between the shelves 92*a*, 92*b*. Upon continued movement, the shelves 92*a*, 92*b* are positioned so that the leading, downwardly pointing surfaces are positioned behind the blocks 94*a*, 94*b*, 94*c* to permit downward movement of the third sidewall extension 23*c*. Following the downward movement the blocks 94*a*, 94*b*, 94*c* will be positioned in the areas behind and below the respective shelves 96*a*, 96*b*, 96*c*.

Figure 12:
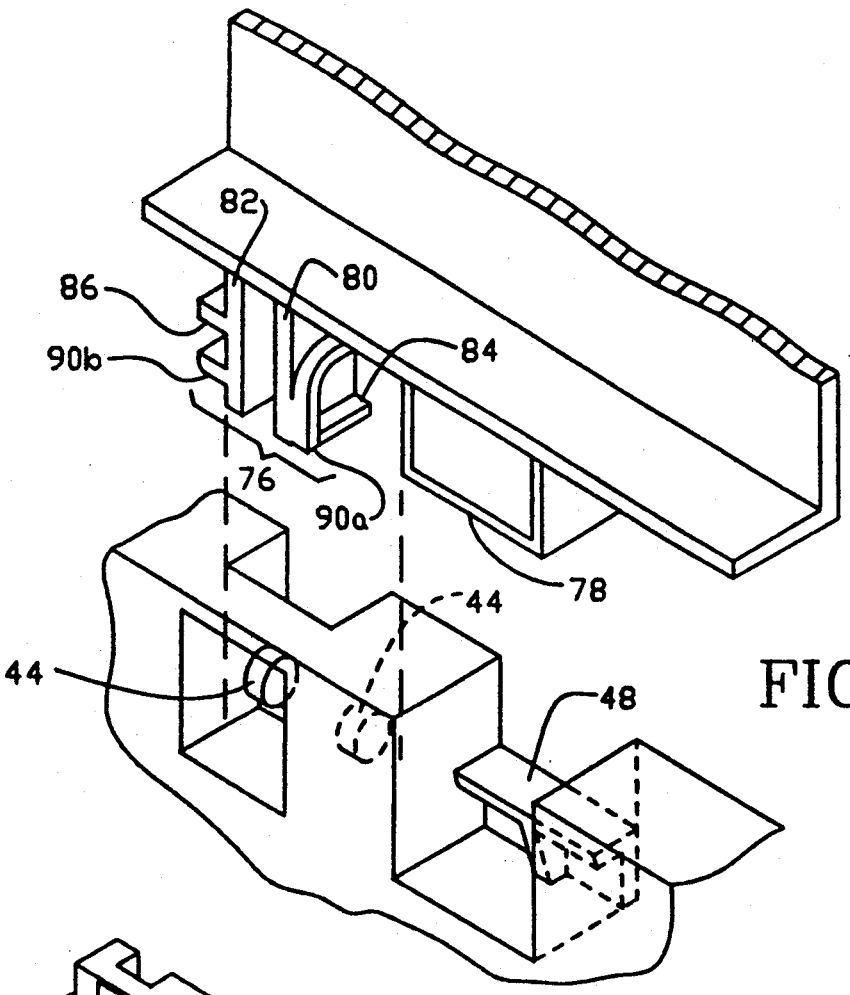
FIG. 12 is a partial exploded rear perspective view of corner portions of the corner portions of the first and second sidewall extensions of FIG. 9.

During such downward movement, the coupling devices are aligned to permit engagement of the pins 44 as best seen in FIG. 12 as the lower ramped surfaces 90*a*, 90*b* contact the pins 44, continued downward movement causes the arms 80, 82 to flex towards each other until the pins 44 are cleared. Thereupon, the arms 80, 82 resiliently move back into to their original configuration, thus containing the pins 44 in their respective recesses 84, 86. The surface 78 rests upon the shelf 48 of the base 22.

Figure 13:
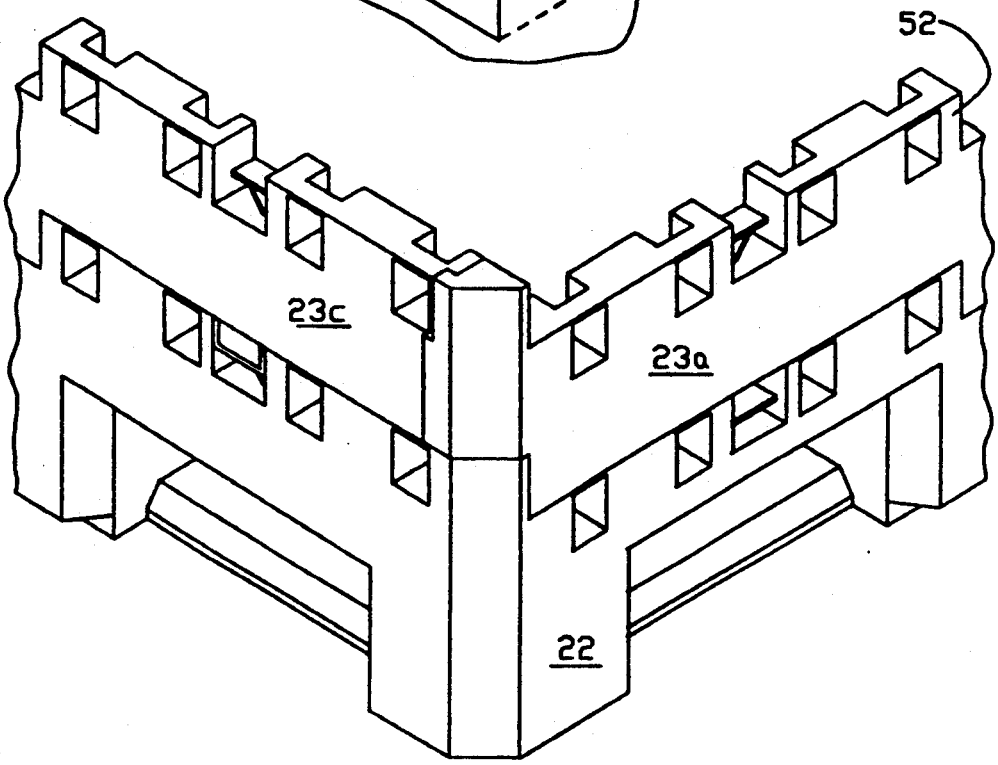
FIG. 13 is a perspective view of the assembled base and first and second sidewall portions.

FIG. 13 depicts the configuration of the container following assembly of the third sidewall extension 23*c*. The assembly of the fourth sidewall extension 23*d* is identical to that described and depicted for the assembly of the third sidewall extension 23*c*.

Following assembly of all sidewall extensions, the sidewalls 24 are attached to the sidewall extensions 23. The manner of attaching the sidewalls 24 to the sidewall extensions 23 is identical to the manner of attaching the sidewalls 24 to the base 22 of previous devices and is well known in the art.

Figure 17:
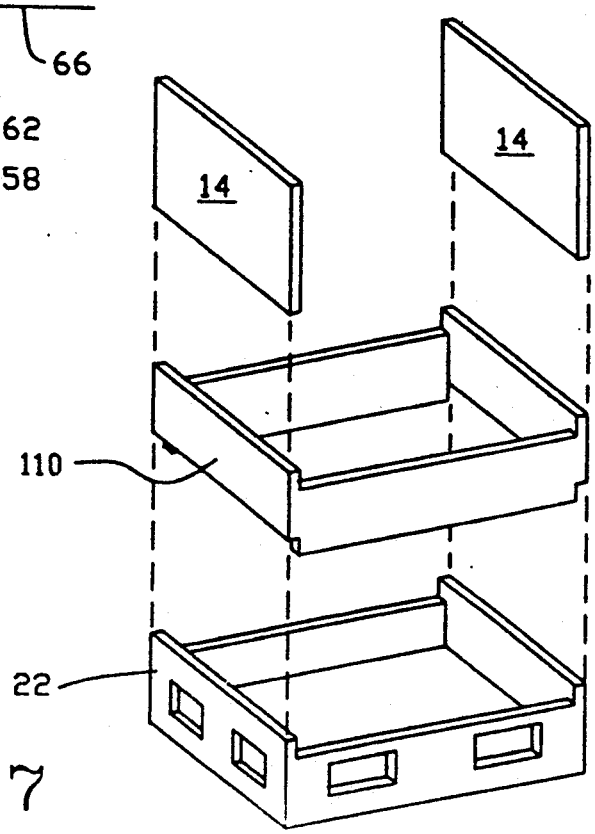
FIG. 17 is a schematic exploded perspective view of a container according to the second embodiment, showing only two of four sidewalls.
Figure 14:
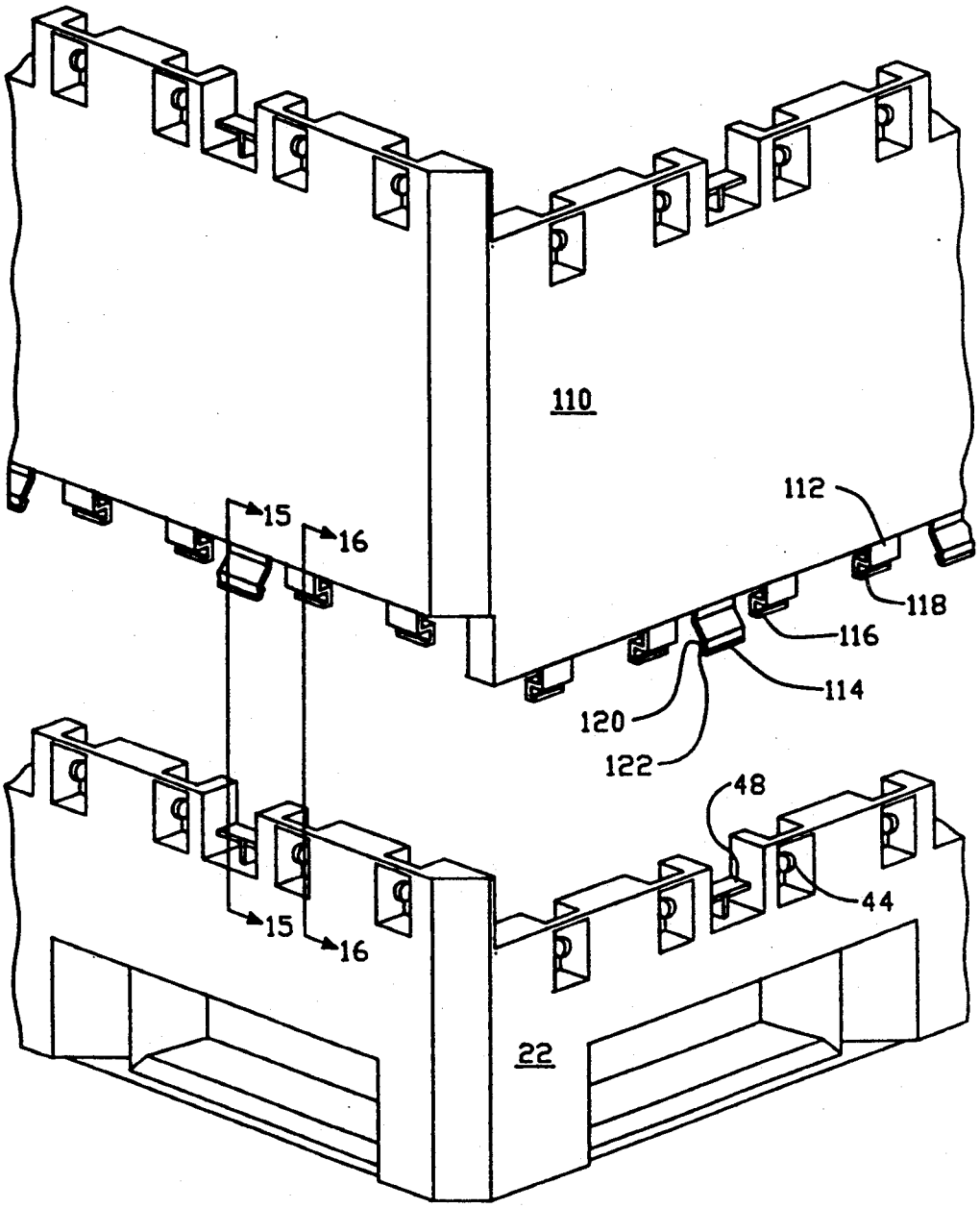
FIG. 14 is a partial exploded perspective view of a base and sidewall extension device according to a second embodiment of the present invention.

An alternative configuration for a sidewall extension is depicted in FIGS. 14 and 17. The sidewall extension 110 of FIG. 14 differs from the sidewall extension 23*a*–23*d* of the previously-described embodiment because, in the embodiment depicted in FIG. 14, a single square-ring shaped sidewall extension device is provided which includes all four walls of the sidewall extension. Because the sidewall extension 110 is a single unitary piece, it is assembled to the base 22 by aligning vertically over the base and pushing vertically downward. It is possible to use the coupling devices depicted in FIG. 10 for this purpose. However, FIG. 14 depicts alternative coupling devices which may also be used. The coupling devices depicted in FIG. 14 includes two types of couplers 112, 114. The first type of coupler 112 is intended to engage the pins 44 while the second type of coupler 114 is intended to engage the shelf 48.

The first coupler 112 has a recess 116 and a ramped lower surface 118. The coupler 112 is configured to permit deflection horizontally towards the interior of the container.

Figure 15:
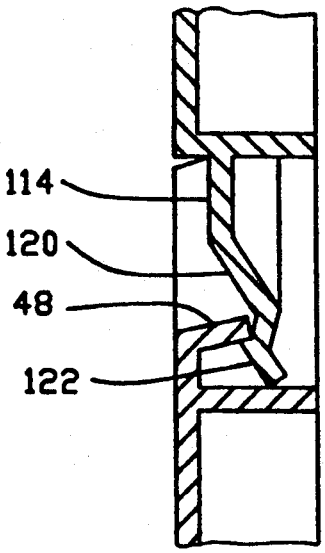
FIG. 15 is a cross-sectional view taken along line 15—15 of FIG. 14.
Figure 16:
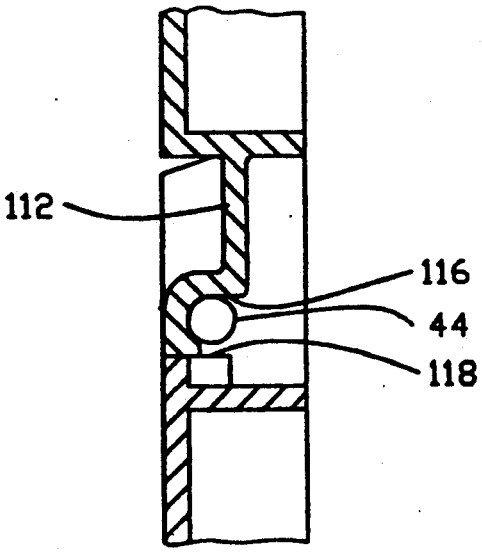
FIG. 16 is a cross-sectional view taken along line 16—16 of FIG. 14.

The second coupler 114 includes a recess 120 and also has a ramped lower surface 122. When the sidewall extension 110 is pushed downward, the lower surfaces 118, 122 engage, respectively, the pins 44 and the shelf 48, causing the couplers 112 and 114 to deflect inwardly and outwardly respectively. After the sidewall extension 110 is moved downwardly to its full extent, and the couplers 114, 112 have cleared the pins and shelf, respectively, the couplers 114, 112 resiliently spring back to their original configurations to engage the pins 44 and shelf 48 as depicted in FIGS. 16 and 15 respectively. Thereafter, the sidewalls 24 can be attached to the extension 110 as described above.

Based on the above description a number of advantages of the present invention are apparent. The depicted interconnection of the sidewalls extensions 23*a*, 23*b* with base 22 provides a number of advantages. The coupling devices 54, 76 of the sidewall extensions 23 are configured to engage devices 44 on the base 22 which are identical to those on the container base 12' used in previous devices. Thus, the base engaging mechanisms 44 can accept with equal facility, either a sidewall extension 23 or a sidewall 24. Further, the rim portions 52 of the sidewall extensions include engagement devices 30 which can be engaged with the coupling devices 34, 32 of the sidewalls 24 in such a manner that the coupling devices 32, 34 of the sidewalls 34 can engage, with equal facility, either the rim of the sidewall extensions or the rim 42 of the base 22. Preferably, the rim of the sidewall extension 52 is substantially identical to the rim portion 42 of the base 22. This arrangement provides a number of beneficial effects. First, the above-described benefits of using sidewall extensions can be achieved without having to redesign or retool the base or sidewall. Further, the container manufacturer can, from the same stockpile of parts, produce both a container with sidewall extensions and those without sidewall extensions.

The depicted sidewall extensions provide the advantage of being particularly economical to produce for at least two reasons. The first reason can be understood by contrasting the method of making the sidewall extender with the method of making the sidewall. During a typical injection molding process, two mating mold parts are configured to move towards each other along a first axis to form the mold. After the injection molding process, the two halves can be pulled apart along the same axis to release the molded part. In certain injection molding processes, it is necessary to produce indentations or pockets. If these indentations or pockets have an axis along the direction of movement of the mold halves, the mold design and construction can be relatively straightforward. However, when it is necessary to provide a blind pocket or indentation with an axis different from the direction of mold movement, design and construction of the mold is much more difficult. Typically, such off-axis blind pockets are produced by providing a third mold component or slide which is moved into the interior of the mold along an axis different from the main mold movement axis by a hydraulic system and, following the injection process, is withdrawn from the mold by the hydraulic process prior to separation of the mold halves. The design of such molds and the equipment needed for production and operation is more involved and expensive than for the straightforward injection mold described above. An example of such a blind pocket is the hub 32 shown in FIG. 3B. In contrast to the sidewalls, which typically require a slide process in order to provide the desired pivoting connection, the sidewall extensions, even though engaging with the same engagement mechanisms which the sidewalls engage, can be produced without a slide process.

The second reason for sidewall extension economy is that the sidewall extensions 23 are preferably of a modular design wherein the central portion of the extension is a repeatable portion. Thus, sidewall extensions of varying height can be produced by providing extensions with more or fewer central portions. Preferably, the molding device used in connection with producing the sidewall extensions is also modular so that central portions can be added to or deleted from the molding device in order to produce sidewall extensions of different heights. Such a procedure reduces the expense of tooling the mold device as well as the expense of design.

A number of variations and modifications of the described embodiments can also be used. Other means of coupling the sidewall extensions to the base can also be provided. The couplers 54 could be provided without providing the latch 56. Other means of latching the edges of the sidewall extensions can be used. The sidewall extensions can be stacked so that two or more levels of sidewall extensions are engaged, one on top of the other. Sidewall extensions could be provided on only some of the sidewalls, depending upon the height of the device desired and the amount of space desired in the collapsed configuration. Other types of container folding schemes can be used in connection with the present invention, such as schemes in which the sidewalls are substantially the same size as the floor. The container could have a shape other than square or rectangular, such as polygonal. The floor need not be flat and could be concave or convex.

Although the present invention has been described by way of a preferred embodiment and certain variations and modifications, other variations and modifications can also be used, the invention being defined by the appended claims.

What is claimed is:

1. A collapsible container, comprising;

a base, said base having a surface defining a base plane said base having a coupling means with a first configuration;

sidewall extension structure, removably coupled to said base, extending in a direction perpendicular to said base plane;

at least four sidewalls, each sidewall being pivotally attached to said sidewall extension to permit movement of said of said sidewalls between a first collapsed configuration substantially parallel to said base plane and an uncollapsed configuration;

said sidewalls being non-integral with said extension structure and pivotally attached to said sidewall extension to permit movement of said sidewall between a first collapsed configuration, substantially parallel to said base plane and an uncollapsed configuration; and said sidewall extension structure having first means for attaching to said base, substantially without modification of said base and second means for pivotally attaching to a sidewall, substantially without modification to said sidewall, said second means including the upper edge configuration of said sidewall extension structure, said sidewall pivotal between a first collapsed configuration and a second uncollapsed configuration; said upper edge configuration of said sidewall extension structure being identical to said first configuration of said base coupling means;

means for releasably latching said sidewall in said uncollapsed configuration wherein said sidewall extension structure is a unitary, ring shaped structure having four sides, each side having a substantially planar surface.

* * * * *